US005608420A

United States Patent [19]

Okada

[11] Patent Number: 5,608,420

[45] Date of Patent: Mar. 4, 1997

[54] LIQUID CRYSTAL DISPLAY APPARATUS

[75] Inventor: Shinjiro Okada, Isehara, Japan

[73] Assignee: Canon Kabushiki Kaisha, Tokyo, Japan

[21] Appl. No.: 215,659

[22] Filed: Mar. 22, 1994

Related U.S. Application Data

[63] Continuation of Ser. No. 872,179, Apr. 22, 1992, abandoned.

[30] Foreign Application Priority Data

Apr. 23, 1991 [JP] Japan ..... 3-117824

[51] Int. Cl.[6] ..... G09G 3/36

[52] U.S. Cl. ..... 345/89; 345/94; 345/99

[58] Field of Search ..... 345/89, 87, 94, 345/96, 97, 99, 208, 147; 359/54, 55, 56; 348/792, 793

[56] References Cited

U.S. PATENT DOCUMENTS

| | | | |
|---|---|---|---|
| 4,639,089 | 1/1987 | Okada et al. | 359/76 |
| 4,681,404 | 7/1987 | Okada et al. | 359/56 |
| 4,682,858 | 7/1987 | Kanbe et al. | 359/56 |
| 4,709,994 | 12/1987 | Kanbe et al. | 359/63 |
| 4,712,872 | 12/1987 | Kanbe et al. | 359/56 |
| 4,712,873 | 12/1987 | Kanbe et al. | 359/56 |
| 4,712,874 | 12/1987 | Sekimura et al. | 359/68 |
| 4,712,875 | 12/1987 | Tsboyama et al. | 359/76 |
| 4,712,877 | 12/1987 | Okada et al. | 345/88 |
| 4,721,367 | 1/1988 | Yoshinaga et al. | 359/76 |
| 4,728,176 | 3/1988 | Tsuboyama et al. | 359/79 |
| 4,740,060 | 4/1988 | Komura et al. | 359/75 |
| 4,744,639 | 5/1988 | Tsuboyama et al. | 359/54 |
| 4,747,671 | 5/1988 | Takahashi et al. | 359/56 |
| 4,763,992 | 8/1988 | Takada et al. | 359/86 |
| 4,763,994 | 8/1988 | Kaneko et al. | 345/89 |
| 4,770,502 | 9/1988 | Kitazima et al. | 359/100 |
| 4,773,738 | 9/1988 | Hayakawa et al. | 359/56 |
| 4,776,676 | 10/1988 | Inoue et al. | 345/89 |
| 4,778,259 | 10/1988 | Kitayama et al. | 359/76 |
| 4,783,148 | 11/1988 | Tsuboyama et al. | 359/76 |
| 4,796,979 | 1/1989 | Tsuboyama | 359/77 |
| 4,800,382 | 1/1989 | Okada | 345/97 |
| 4,802,740 | 2/1989 | Hotta et al. | 359/76 |
| 4,818,075 | 4/1989 | Takao et al. | 359/68 |
| 4,818,078 | 4/1989 | Mouri et al. | 359/56 |
| 4,820,026 | 4/1989 | Okada et al. | 359/78 |
| 4,836,656 | 6/1989 | Mouri et al. | 359/56 |
| 4,844,590 | 7/1989 | Okada et al. | 359/56 |
| 4,869,577 | 9/1989 | Masaki | 359/76 |
| 4,878,740 | 11/1989 | Inaba et al. | 359/63 |

(List continued on next page.)

FOREIGN PATENT DOCUMENTS

| | | |
|---|---|---|
| 0453856 | 10/1991 | European Pat. Off. . |
| 0469531 | 2/1992 | European Pat. Off. . |
| 61-094023 | 5/1986 | Japan . |

*Primary Examiner*—Kee M. Tung
*Assistant Examiner*—Doon Chow
*Attorney, Agent, or Firm*—Fitzpatrick, Cella, Harper & Scinto

[57] ABSTRACT

A liquid crystal display apparatus has a display section for displaying an image or other data. The display section including scanning electrodes and signal electrodes which are arranged to cross each other to form a matrix of pixels, and a ferroelectric liquid crystal filling the gap between the scanning electrodes and the signal electrodes. The ferroelectric liquid crystal has first stable states in alignment with the direction of an electric field. The apparatus has a circuit for applying a reset pulse (A) to a selected scanning electrode so as to reset all the pixels on the scanning electrode into the first stable state, and a circuit for applying at least writing pulse (B to D) following the reset pulse so as to write the data in such a sequence that the writing into the pixel having the highest inversion threshold level is conducted first. The apparatus also has a control circuit for controlling the timing of application of the pulses in such a manner that a time interval not shorter than a relaxation time, which is the time required for the liquid crystal to be set again to a state exhibiting the same inversion threshold value as that exhibited before the application of the immediately preceding pulse, is preserved between successive pulses.

6 Claims, 9 Drawing Sheets

U.S. PATENT DOCUMENTS

| | | | |
|---|---|---|---|
| 4,879,059 | 11/1989 | Hanyu et al. | 359/75 |
| 4,898,456 | 2/1990 | Okada et al. | 359/56 |
| 4,907,859 | 3/1990 | Takada et al. | 359/56 |
| 4,917,471 | 4/1990 | Takao et al. | 359/68 |
| 4,932,757 | 6/1990 | Hanyu et al. | 359/75 |
| 4,932,758 | 6/1990 | Hanyu et al. | 359/100 |
| 5,000,545 | 3/1991 | Yoshioka et al. | 359/87 |
| 5,007,716 | 4/1991 | Hanyu et al. | 359/87 |
| 5,013,137 | 5/1991 | Tsuboyama et al. | 359/56 |
| 5,026,144 | 6/1991 | Taniguchi et al. | 359/56 |
| 5,054,890 | 10/1991 | Hanyu et al. | 359/80 |
| 5,078,475 | 1/1992 | Sekimura et al. | 259/68 |
| 5,092,665 | 3/1992 | Kanbe et al. | 340/784 |
| 5,095,377 | 3/1992 | Kobayashi et al. | 340/784 |
| 5,119,219 | 6/1992 | Terada et al. | 340/784 |

LIQUID CRYSTAL DISPLAY APPARATUS

This application is a continuation of application Ser. No. 07/872,179 filed Apr. 22, 1992, now abandoned.

BACKGROUND OF THE INVENTION

1. Field of the Invention

The present invention relates to a liquid crystal display apparatus which employs a ferroelectric liquid crystal and, more particularly, to a liquid crystal display apparatus which performs display with gradation control.

2. Description of the Related Art

Japanese Patent Laid-Open Publication No. 61-94023 discloses a display apparatus which employs a ferroelectric liquid crystal. More particularly, this liquid crystal display apparatus employs a pair of glass substrates which are provided with transparent electrodes on their inner surfaces and which have been subjected to an orientation or alignment treatment. The glass substrates are disposed to oppose each other leaving therebetween a gap of 1 to 3 microns. The gap is filled with a ferroelectric liquid crystal.

A liquid crystal display device employing a ferroelectric liquid crystal is conveniently switched by a combination of an external electric field and spontaneous polarization possessed by the ferroelectric liquid crystal. In addition, switching can easily be effected by changing the polarity of the external electric field by virtue of the fact that the direction of the longer axes of the ferroelectric liquid crystal molecules corresponds to the direction of the spontaneous polarization.

On the other hand, various liquid crystal display devices using chiral smectic liquid crystal are disclosed in the following United States Patents: U.S. Pat. Nos. 4,639,089; 4,681,404; 4,682,858; 4,709,994; 4,712,872; 4,712,873; 4,712,874; 4,712,875; 4,721,367; 4,728,176; 4,740,060; 4,744,639; 4,747,671; 4,763,992; 4,773,738; 4,776,676; 4,778,259; 4,783,148; 4,796,979; 4,800,382; 4802,740; 4,818,075; 4,818,078; 4,820,026; 4,836,656; 4,844,590; 4,869,577, 4,878,740; 4,879,059; 4,898,456; 4,907,859; 4,917,471; 4,932,757; 4,932,758; 5,000,545; 5,007,716; 5,013,137; 5,026,144; 5,054,890; and 5,078,475.

In general, however, chiral smectic liquid crystal has a bi-stable characteristic, so that it has been difficult to display an image with gradation control by using this type of liquid crystal.

SUMMARY OF THE INVENTION

Accordingly, an object of the present invention is to provide a liquid crystal display apparatus which employs a ferroelectric liquid crystal or a chiral smectic liquid crystal and which can display an image with high degree of gradation.

To this end, according to one aspect of the present invention, there is provided a liquid crystal display apparatus having a display section for displaying an image or other data, the display section including scanning electrodes and signal electrodes which are arranged to cross each other to form a matrix of pixels, and a ferroelectric liquid crystal filling the gap between the scanning electrodes and the signal electrodes and capable of taking a first stable state and a second stable state in alignment with the direction of an electric field produced by a voltage applied between the electrodes, the liquid crystal display apparatus comprising: means for applying a reset pulse to a selected scanning electrode so as to reset all the pixels on the scanning electrode into the first stable state, and for applying at least one gradation writing pulse following the reset pulse; and control means for controlling the timing of application of the pulses in such a manner that a time interval not shorter than a relaxation time, which is the time required for the liquid crystal to be set to a state in which the inversion threshold voltage of the liquid crystal is substantially free from any influence of an immediately preceding pulse, is preserved at least between the second and third writing pulses onwards.

The above and other objects, features and advantages of the present invention will become clear from the following description of the preferred embodiments when the same is read in conjunction with the accompanying drawings.

DETAILED DESCRIPTION OF THE DRAWINGS

In general, a ferroelectric liquid crystal has two stable states, i.e., a transparent state and a light interrupting state, and is used mainly in a binary image display device which displays a binary image either in white corresponding to the transparent state or black corresponding to the light-interrupting state. It is to be noted, however, that this type of liquid crystal is usable also for multi-value or gradation display which requires various halftone levels. One halftone display method is to realize intermediate levels of light transmission by controlling, in each of the pixels, the area ratio (Iop (%) between two stable states of the liquid crystal. This display method, known as "area modulation method", will be described hereinunder.

Figure 9:
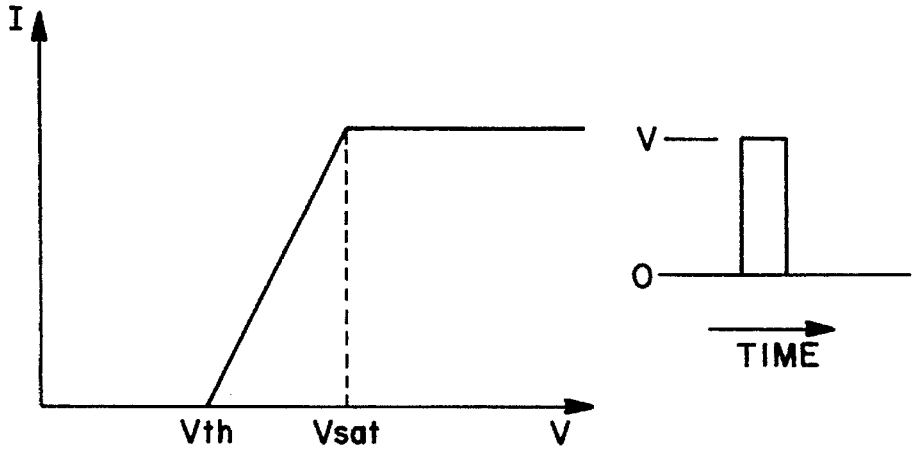
FIG. 9 is a graph showing the relationship between voltage applied to a liquid crystal cell and illuminance of the liquid crystal cell.
Figures 10A, 10B, 10C, 10D:
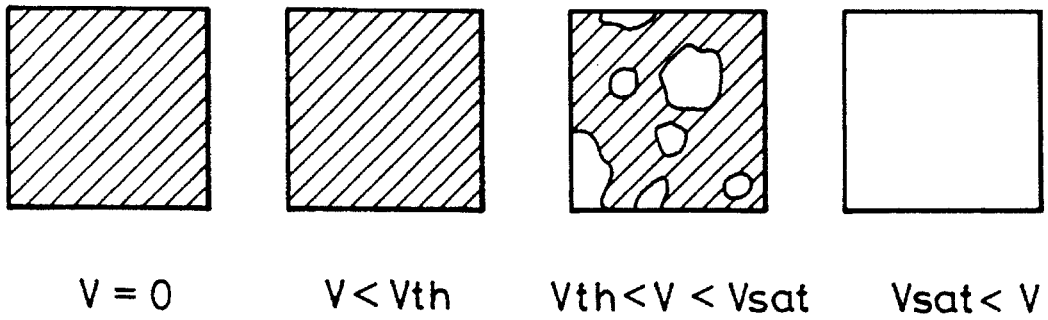
FIG. 10 is an illustration of the relationship between voltage applied to a liquid crystal cell and the state of display performed by the liquid crystal cell.

FIG. 9 is a graph schematically showing the relationship between the amplitude of a switching pulse applied to a ferroelectric liquid crystal device and the light transmittance of the device. More specifically, a pulse was applied to a liquid crystal cell (device) which is initially in the light-interrupting (black) state, and the quantity I of light transmitted through the cell was measured. Similar measurements were conducted by varying the amplitude of the pulse, without changing the polarity of the pulse. Then, the quantities I of transmitted light versus amplitudes V were plotted to provide the graph shown in FIG. 9. Thus, FIG. 9 shows the quantity I of light transmitted by the liquid crystal cell as a function of the pulse amplitude V. FIGS. 10(*a*) to 10(*d*) show the states of the liquid crystal cell in relation to the amplitude of the pulse applied to the cell. FIG. 10(*a*) shows the initial black state, i.e., when no pulse has been applied to the liquid crystal cell. As will be seen from FIG. 9 and FIGS. 10(*a*) to 10(*d*), no change in the transmitted light quantity is caused when the pulse amplitude V is below a predetermined threshold $V_{th}$ ($V<V_{th}$), as will be seen from FIG. 10(*b*) in comparison with FIG. 10(*a*). When the pulse amplitude increases to a value which exceeds the threshold but still below a saturation level $V_{sat}$ ($V_{th}<V<V_{sat}$), a portion of each pixel is changed into the other stable state, i.e., to a transparent state, as shown in FIG. 10(*c*), so that the pixel exhibits an intermediate level of light transmission. When the pulse amplitude is further increased to a level exceeding the saturation level ($V>V_{sat}$), the entire portion of the pixel is switched to the other stable state, i.e., the transparent state, so that the quantity of the transmitted light becomes constant as shown in FIG. 10(*d*).

Thus, in the area modulation method, halftone levels of displayed image are realized by controlling the pulse amplitude within the range expressed by $V_{th}<V<V_{sat}$.

This simple driving method, however, causes the following disadvantage, due to the fact that the relationship between the voltage and light transmittance shown in FIG. 9 has dependencies both on the cell thickness and the temperature. Namely, when there is a thickness distribution or temperature distribution in the display panel, different levels of halftone are created in response to the pulse of a given amplitude, thus making it difficult to obtain good gradation control.

Figure 11:
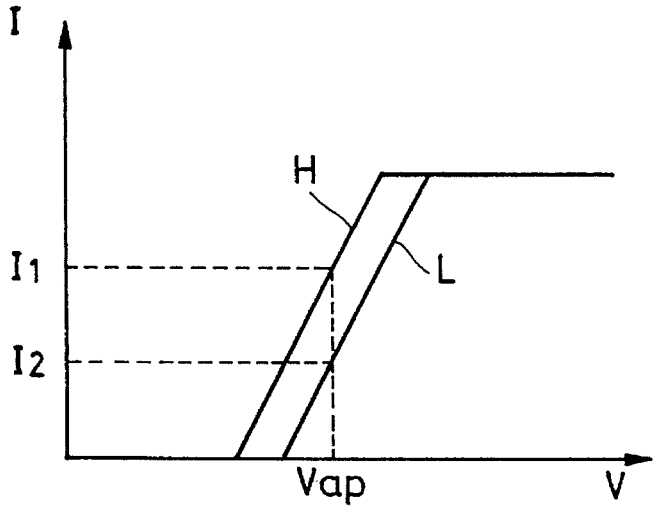
FIG. 11 is an illustration of temperature-dependency of inversion characteristic of a liquid crystal cell.

This problem will be explained in more detail with reference to FIG. 11. FIG. 11 shows, as in the case of FIG. 9, the relationship between the voltage amplitude V and the transmitted light quantity I. In this Figure, however, there appear two curves: one designated at H showing the above-mentioned relationship as observed when the cell temperature is comparatively high and the other designated at L showing the same relationship as observed when the cell temperature is low. A large-size display often exhibits a temperature variation or distribution within a region which is covered by the same driving pulse. Therefore, any attempt to create a certain level of halftone by a certain pulse voltage amplitude $V_{ap}$ often results in lack of uniformity of halftone level over a wide range between I1 and I2 shown in FIG. 11.

Figure 6:
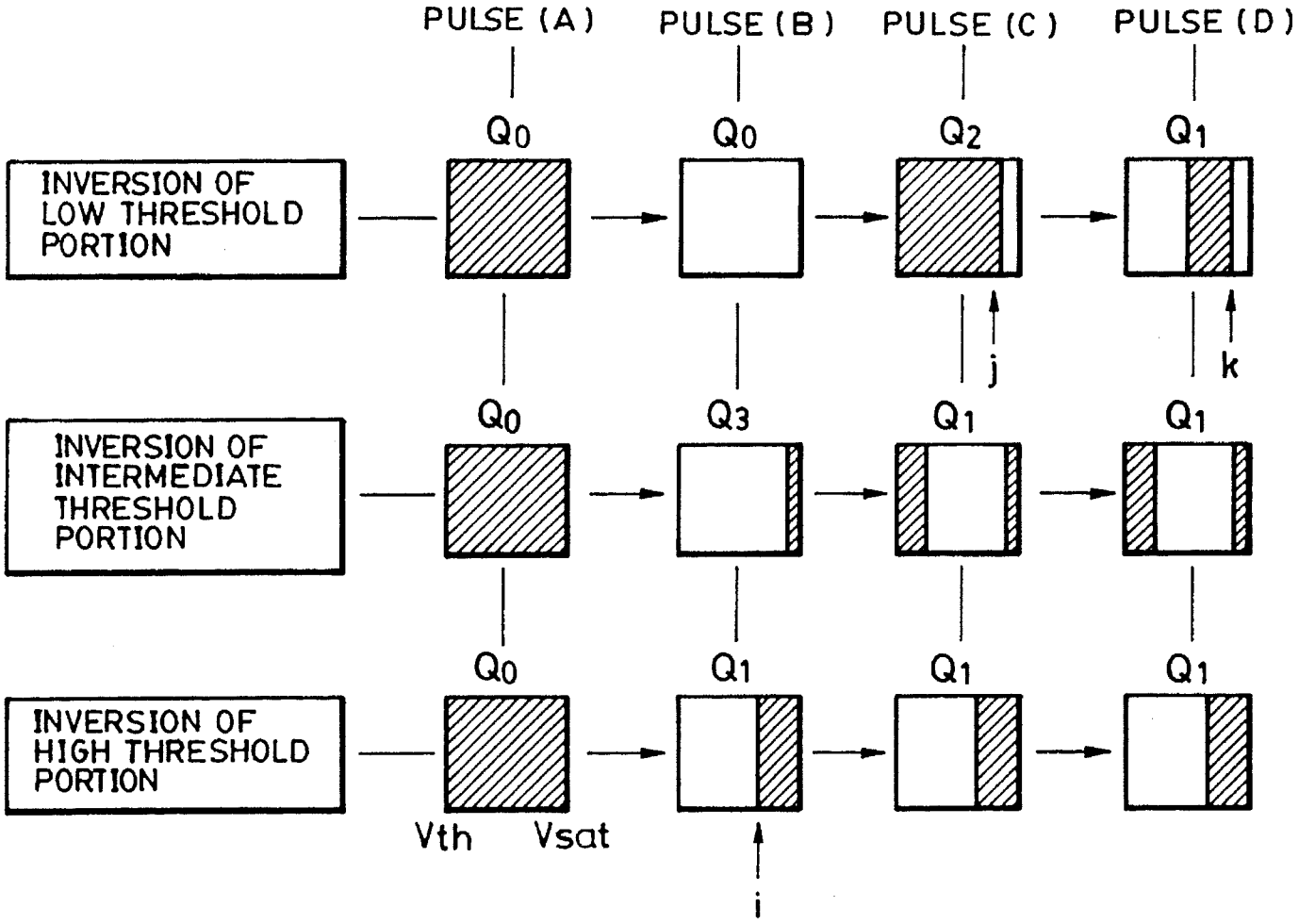
FIG. 6 is an illustration of states of inversion of pixels in a low-threshold portion, intermediate threshold portion and the high-threshold portion of a liquid crystal cell, caused by application of pulses A to D.
Figure 12:
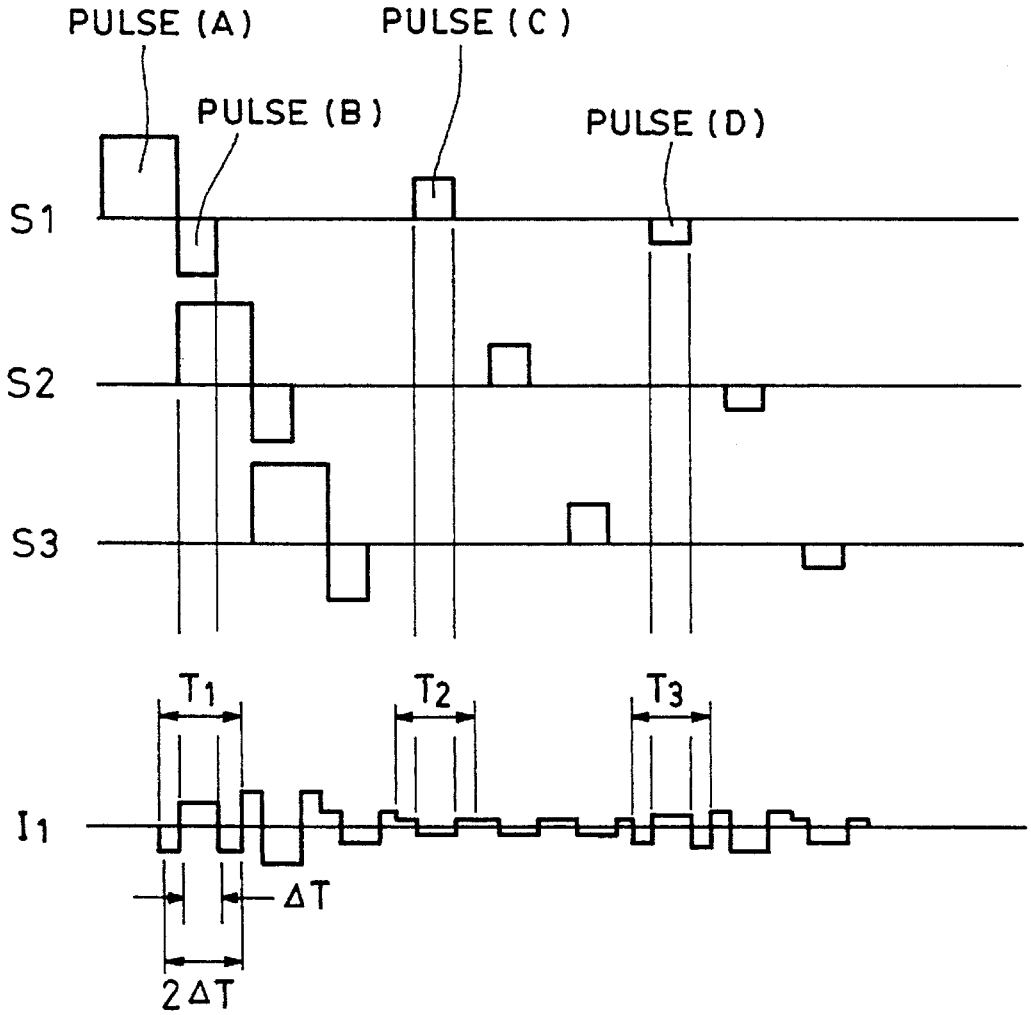
FIG. 12 is a waveform chart showing the waveform of a driving voltage used in a known driving system.

In order to obviate this problem, a method called the "4-pulse" method has been proposed by the inventor of the present invention in EP 453856 A2. As shown in FIGS. 6 and 12, this method employs four pulses A, B, C and D which are applied to low-threshold and high-threshold portions of the same scanning line, whereby an equal area of inversion can be finally obtained.

In this 4-pulse method, a reset pulse A is applied to pixels on a selected scanning line, followed by sequential application of pulses B, C and D. This 4-pulse method, however, suffers from the following problems:

(1) Each of the writing pulses B, C and D is influenced by the preceding pulse. More specifically, the voltage at which the state of the liquid crystal is inverted, i.e., the threshold level, slightly varies according to the voltage of the preceding writing pulse. This problem is critical particularly for the setting of the pulse B. If the variation of the threshold level due to the influence of the preceding pulse is very small, such a variation would be regarded as permissible, although the precision of gradation control may be slightly degraded. However, if the variation in the threshold level caused by the preceding pulse is large, the 4-pulse method cannot be applied, because the 4-pulse method proposed in EP 453856 A2 is based on an assumption that the liquid crystal has the same inversion characteristic, i.e., threshold levels, for all of these four pulses. (2) Application of the pulse A shown in FIG. 6 can be conducted without problem because the pulse A which is a reset pulse can have an amplitude which is sufficiently higher than the threshold level. In case of other pulses B, C and D, however, the amplitudes have to be delicately controlled in the regions very near the threshold levels, because they must create domain walls i, j and k within each pixel. In such cases, the switching of the liquid crystal is conducted by a pulse which exceeds the threshold level only slightly, so that any variation in the threshold level seriously affects the position of the domain wall i, j and k within each pixel. The influence of the immediately preceding pulse voltage is not so serious when the difference between the voltages of the successive pulses is small. When the voltage difference is large, however, the 4-pulse method cannot be effectively carried out.

(3) The threshold level of inversion of the liquid crystal also is affected by the voltage of a pulse which is applied immediately after the writing. For instance, assuming that a domain wall j is set as illustrated in FIG. 6, the position of the wall j is undesirably shifted when the pulse applied subsequently to the pulse C has a voltage amplitude which is greater than a certain level. That is, the writing pulse tends to be influenced by a crosstalk of the next pulse.

(4) Another problem is that, even when the shifting of the threshold voltage and crosstalk is not so serious, a difficulty is encountered due to the use of a greater number of writing pulses than in the known driving method. Namely, the 4-pulse method requires application of four pulses A, B, C and D, which should be contrasted to known methods which employ only the pulses A and B, i.e., one write pulse following a reset pulse. This means that a longer time is required for writing data on the whole panel area, i.e., a longer frame time, so. that the quality of the display is seriously affected not only when a motion picture is displayed but also when the frame is continuously changed. In the worst case, the display is possible only for a still image.

Thus, the 4-pulse method inherently has error factors as stated in (1) to (3) above, as well as delay in the display as stated in (4) above.

Figure 8:
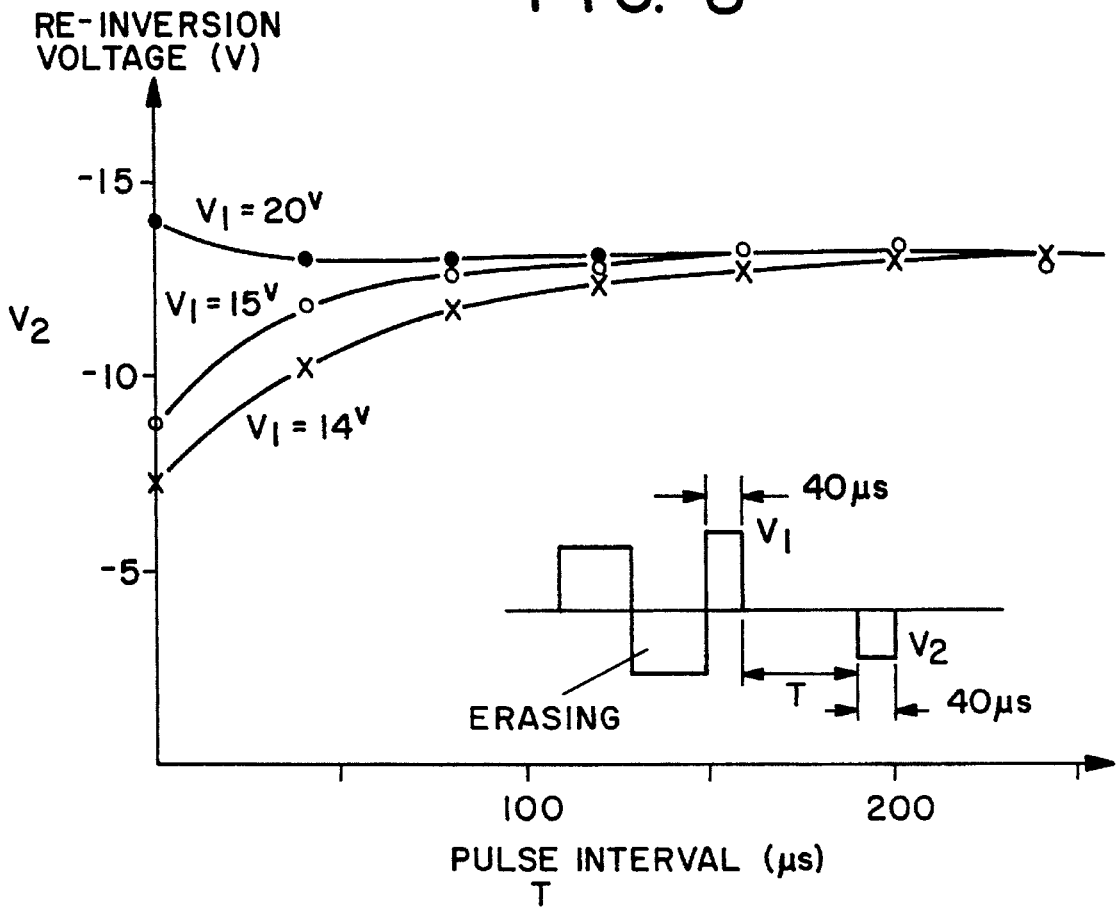
FIG. 8 is a graph showing the relationship between pulse interval and re-inversion voltage.

In order to overcome these problems, according to the present invention, the timing of at least one of the pulses is commonly set for a plurality of scanning lines. FIG. 8 shows the result of an experiment conducted for the purpose of examining relaxation time. More specifically, a driving waveform as shown in FIG. 8 was applied to a liquid crystal cell. After erasing, data was written in a pixel at a voltage V1 and, after an interval T, writing was conducted in the same pixel by a pulse of a voltage V2. The relationship between the time interval T and the pulse voltage V2 is shown in FIG. 8.

From FIG. 8, it will be seen that the threshold level at which the state of the liquid crystal is inverted is influenced by the voltage level V1 of the preceding pulse, but the influence of the preceding pulse is reduced to a negligible level when the time interval exceeds 200 μS. That is, the minimum relaxation time of the liquid crystal cell used in the experiment shown in FIG. 8 is 200 μS.

In the experiment, no voltage pulse was applied during the time interval T. The above-described effect of the relaxation, however, was not substantially changed even when a low-voltage A.C. pulses of ±5 V or so was applied during the time interval T. The period T is shortened when a pulse of a predetermined level was applied immediately after the pulse V1. Normally, however, it is necessary to set the time interval to a value somewhat longer than the minimum relaxation time.

It is thus understood that any shifting of the threshold level caused by a preceding pulse can be substantially eliminated if a time interval which is not shorter than the minimum relaxation time is set between successive pulses.

According to the present invention, a plurality of pulses are applied at such a time interval that allows the liquid crystal to be reset, after application of each pulse, to a state which exhibits the constant inversion characteristic, i.e., the minimum relaxation time, whereby any variation or shifting of the threshold level caused by the preceding pulse can be eliminated.

Furthermore, the scanning time for one frame can be shortened because the timing of application of at least one of the plurality of pulses is set commonly for a plurality of scanning lines.

A preferred embodiment of the present invention will be described.

Figure 1:
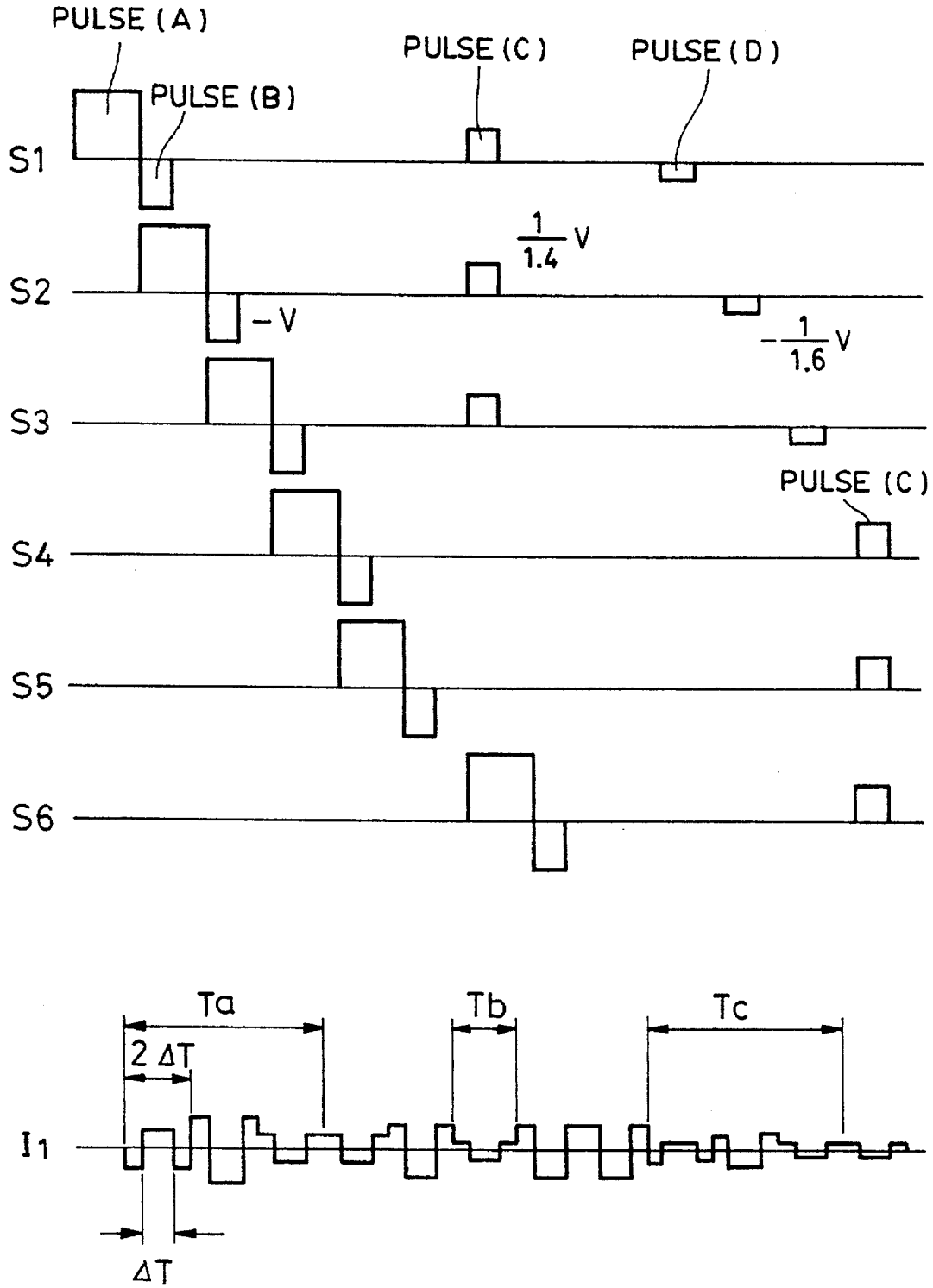
FIG. 1 is a waveform chart showing the waveform of a driving voltage for driving a liquid crystal cell matrix incorporated in an embodiment of the present invention.

FIG. 1 is a waveform chart illustrating, by way of example, the waveform of driving voltage applied to an embodiment of the liquid crystal cell matrix incorporated in an embodiment of the present invention. The driving voltage is applied basically in accordance with the 4-pulse method but the time interval between successive writing pulses is determined to be greater than the minimum relaxation time which is required for relaxing, after each application of a writing pulse, the liquid crystal to such a state that it exhibits the same state of molecular alignment or orientation for all writing pulses which are applied successively. In addition, at least one of the plurality of the pulses is applied at a common timing to a plurality of scanning lines, so as to shorten the time required for scanning of one frame of the display.

Referring to FIG. 1, S1, S2, S3, S4, S5 and S6 are time charts showing waveforms of scanning signals which are supplied sequentially. Each of the scanning signals is composed of four pulses A, B, C and D. In FIG. 1, I1 is a timing chart showing the waveform and timing of a data signal. Thus, FIG. 1 shows, by way of example, timings and waveforms of signals applied to one data signal line and six scanning signal lines.

Figure 2:
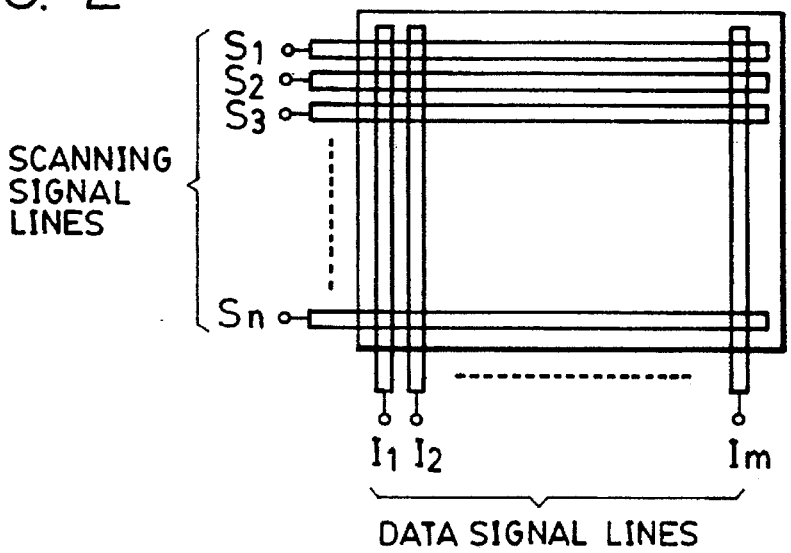
FIG. 2 is an illustration of arrangement of electrodes in an ordinary matrix-type device.

FIG. 2 illustrates an electrode arrangement adopted in an ordinary matrix device. The matrix is composed of scanning signal lines S1 to Sn and data signal lines lI to Im.

Figure 3:
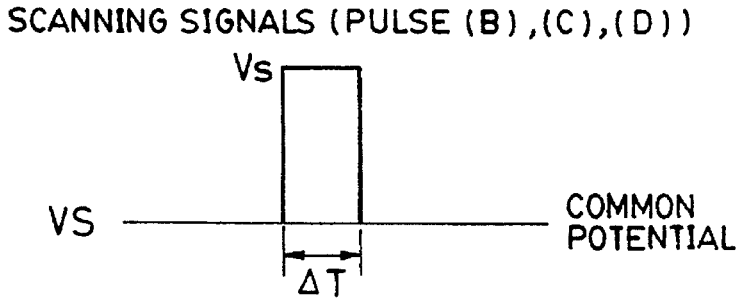
FIG. 3 is a waveform chart showing a basic pattern of the waveform of a matrix driving voltage.
Figure 3:
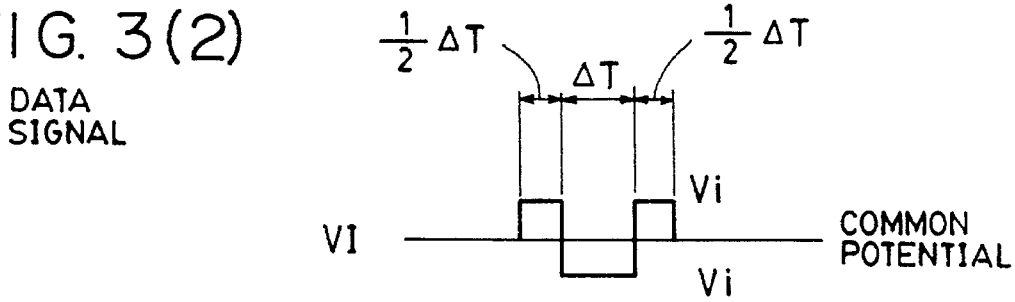
Figure 3:
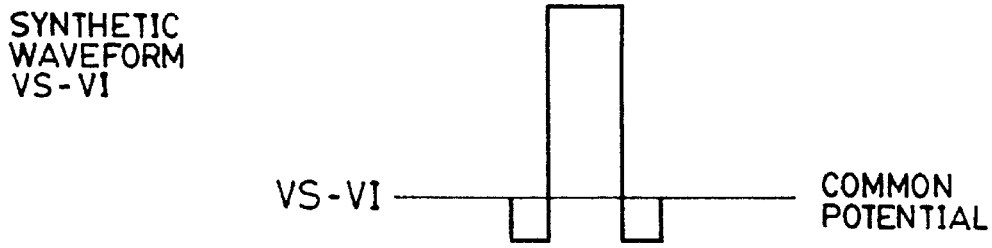

FIG. 3 shows basic patterns of waveforms of signals for driving the matrix used in the present invention. Each of the scanning signals VS (pulses B, C and D) is a pulse having a width ΔT and an amplitude $V_s$, while the data signal VI is a pulse which is composed of a central portion of an amplitude $-V_i$ and concurrent with the scanning signal VS and leading and trailing end portions of an amplitude $V_i$ and widths ΔT/2. Thus, the data signal VI has a total pulse width 2ΔT and a mean amplitude 0 (zero). A composite waveform composed of the scanning signal VS and the data signal VI is applied to the pixel which is provided on each of the points where the scanning signal lines and the data signal lines intersect each other. The composite voltage $V_s$ $V_i$ contributes to the inversion of the state of each pixel. Either one of the voltage amplitude $V_s$ of the scanning signal pulses B, C and D or the voltage amplitude $V_i$ of the data signal pulse may be fixed, provided that the composite voltage $V_s-V_i$ applied to the pixel can be controlled to a desired gradation voltage. A pulse having a width 2ΔT and a voltage amplitude not lower than $V_{sat}$ is applied as the scanning signal for resetting (pulse A), regardless of the data signal VI. Namely, resetting of the pixels on each scanning line is effected by applying a sufficiently high voltage to this scanning line, while data is being written in other lines. The period of the pulse A, therefore, is not included in the period of one line.

Figure 4:
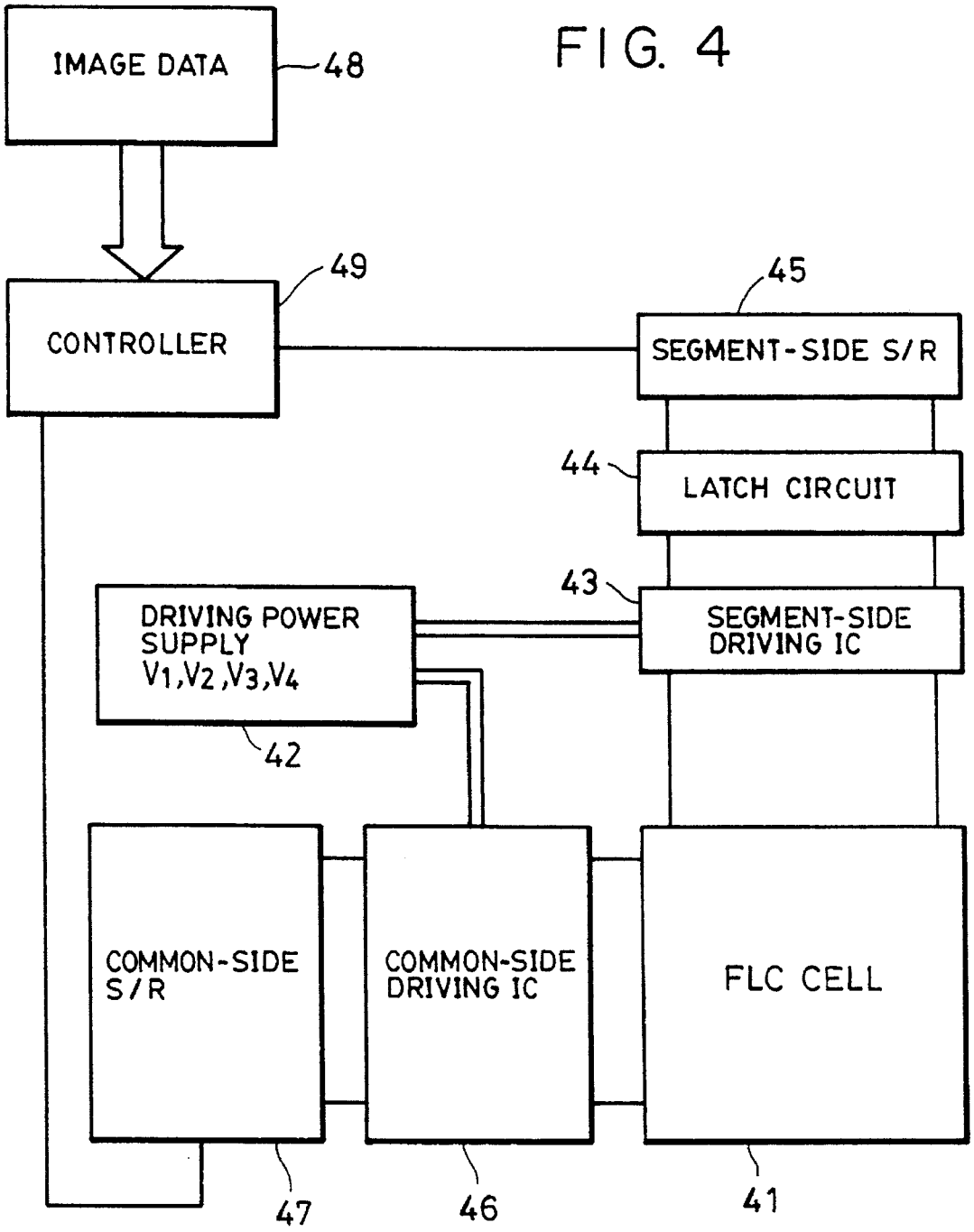
FIG. 4 is a block diagram of a liquid crystal display apparatus embodying the present invention.

FIG. 4 is a block diagram of a circuit for applying the signal of FIG. 1 to a liquid crystal cell. In order to supply the signal of FIG. 1 to the liquid crystal cell denoted by 41, the circuit includes a driving power supply 42 capable of outputting a voltage of various levels, a segment-side driving IC 43, a latch circuit 44, a segment-side shift register 45, a common-side (driving side) IC 46, a common-side shift register 47, an image data generating device 48 and a controller 49.

The circuit shown in FIG. 4 is capable of supplying gradation signals, i.e., voltages of different levels. To this end, a DA converter is provided in the segment-side IC 43 which converts digital gradation signals supplied through the latch circuit 44 and carrying, for example, $2^4=16$ gradation levels in the case of 4-bit signals, into corresponding ones of 16 (sixteen) different analog data signals which are applied to segment lines (data signal lines I1 to Im). In this case, the commonside (scanning) driving IC 46 generates the scanning signals by distributing, by means of an analog switch, the power of the driving power supply 42. This arrangement, however, is not exclusive. For instance, the supply of the analog signal to the segment lines may be performed by a circuit in which a capacitor is provided in parallel with the driving IC so as to permit direct input of the analog signal.

In this embodiment, the liquid crystal cell to which the driving signals such as scanning signals S1, S2 and S3 and the data signal I1 are applied has a certain pattern of distribution or variation of the inversion threshold level in each pixel. Typically and preferably, a cell in which the cell thickness is changed in each pixel as shown in FIG. 5 is used as the above-mentioned liquid crystal cell.

Figure 5:
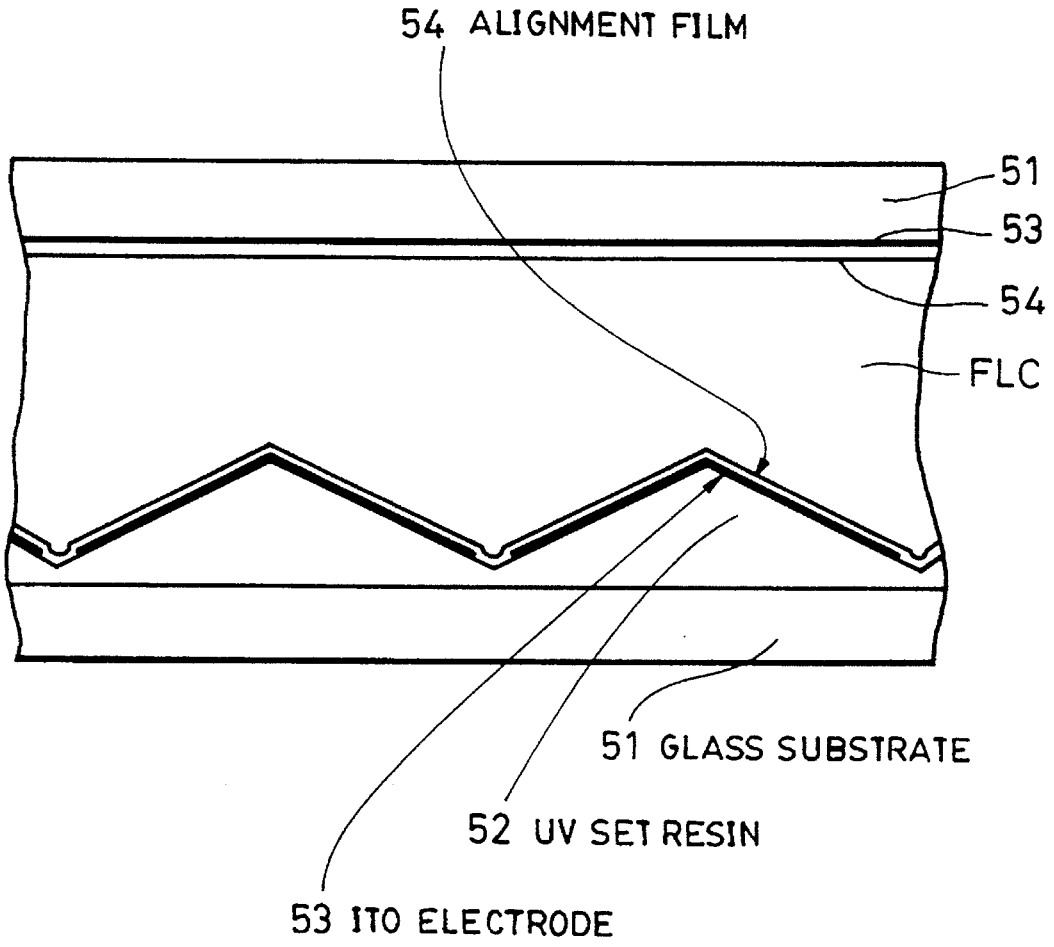
FIG. 5 is a sectional view of a liquid crystal cell the thickness of which is changed in each pixel.

Referring to FIG. 5, numeral 51 denotes glass substrates, 52 denotes a UV set resin, 53 denotes an ITO striped electrodes including both scanning and data electrodes, and 54 denotes alignment films made of polyimide.

FIG. 6 shows the states of inversion of liquid crystal cells caused by application of the pulses A to D, in each of three pixels which are in a low-threshold portion, intermediate-threshold portion and a high-threshold portion, respectively. It is assumed that each pixel has a gradient of the inversion threshold level which progressively increases from the left end to the right end of the illustrated pixel square.

With specific reference to FIG. 6, a description will now be given of a method for writing gradation data by using the driving waveform shown in FIG. 1.

(1) A reset pulse A, having a voltage amplitude not smaller than the saturation voltage level $V_{sat}$, is applied to a scanning line so as to reset all the pixels on this scanning line.

(2) Writing is performed in the high-threshold portion of the scanning line by application of a pulse B. In this state, excessive writing is effected on the pixels of the low- and intermediate-threshold portions.

(3) Then a pulse C is applied so that portions of voltage levels lower than the voltage applied by the pulse C are changed into the same state as the reset state. Preferably, the voltage applied by the pulse C is equal to the threshold voltage Vth of the pixel of the high-threshold portion.

(4) Then, a pulse D is applied so that writing is conducted again such that the pixel of the low-threshold portion exhibits the same gradation level as the pixel of the high-threshold portion.

It will be seen that the writing in the pixel of the high-threshold portion is completed by the steps(1) and (2) described above, while the writing in the intermediate-threshold portion and low-threshold portion additionally requires, respectively, the step (3) and the steps (3) and (4).

According to the invention, the described 4-pulse method is carried in such a manner that the pulse C is applied at the same timing to a plurality of scanning lines (three scanning lines in FIG. 3). Therefore, as will be seen from FIG. 1, the total scanning times required for conducting scanning over three scanning lines is expressed by $Ta+Tb+Tc=6\Delta T+2\Delta T+6\Delta T=14\Delta T$. In contrast, in the known 4-pulse method illustrated in FIG. 12, the scanning time for each scanning line is expressed by $T1+T2+T3=6\Delta T$ and the total time required for scanning over three scanning lines is $6\Delta T\times 3=18\Delta T$.

Assuming that the pulse width $\Delta T$ of the writing pulse is 40 μs and that the number of the scanning lines is 400, the present invention offers about 21 ms reduction in the frame time, as expressed by $(18-14)\times 40\ \mu s\times 400\simeq 21$ ms.

Figure 7:
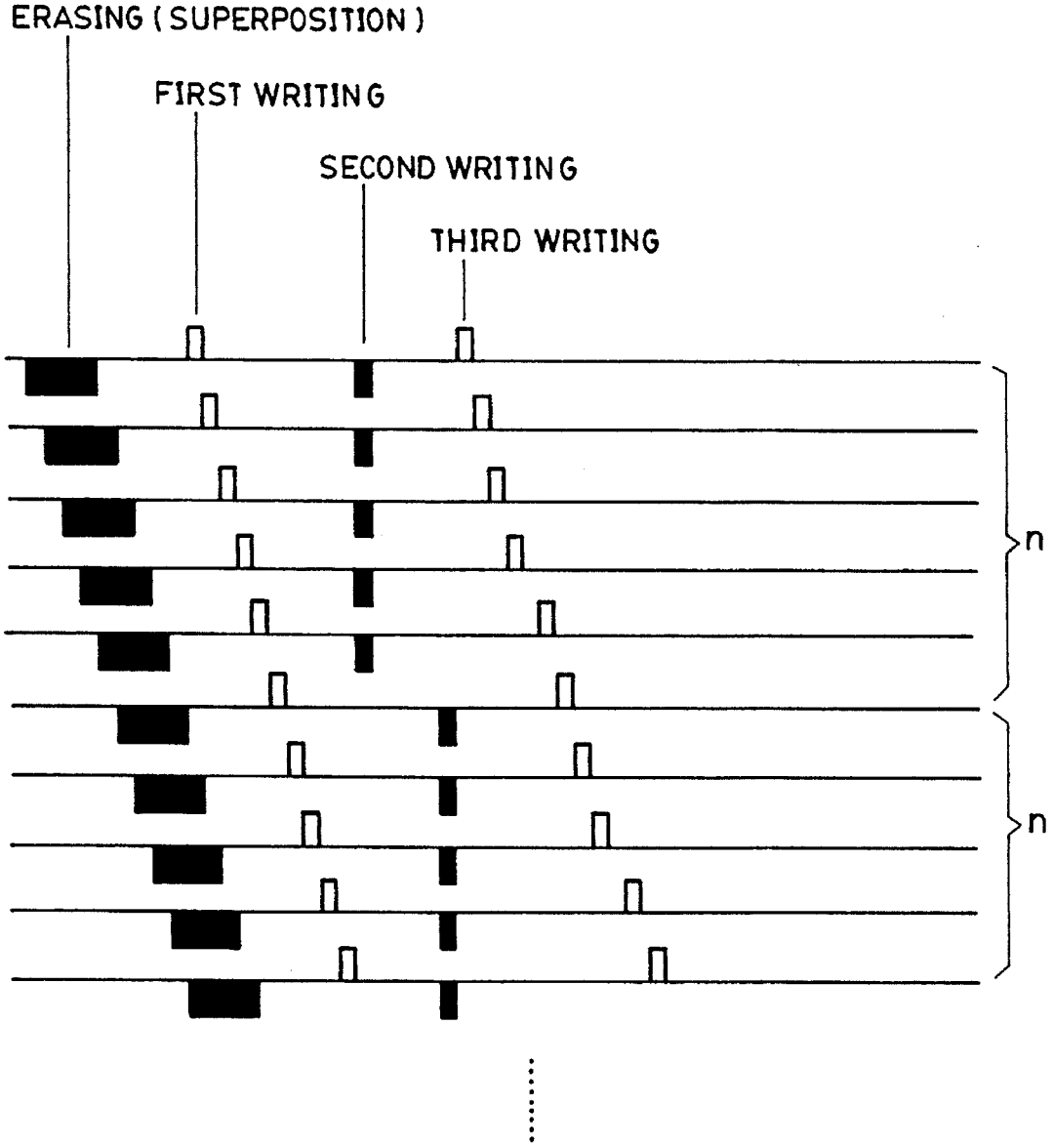
FIG. 7 is a waveform chart showing the waveform of a driving voltage used in a matrix in which the scanning lines are grouped into groups each having n scanning lines.

FIG. 7 is a time chart showing timings of signals applied to the device in accordance with the present invention when the scanning lines are grouped into a plurality of groups each containing n scanning lines. The invention can most simply and easily be carried out by using, as the pulse of a timing common to n scanning lines, the pulse C whose amplitude does not have dependency on the gradation. This, however, is only illustrative and the invention can be carried out by adopting the common timing for the pulse B or D, if a voltage amplitude control according to gradation level is considered. In FIG. 7, pulses painted in black are for writing black data, while white-blank pulses are for writing white data.

A display with a stable gradation control could be attained by providing the liquid crystal display device of the embodiment such that a time interval not shorter than the relaxation time of 200 μs was preserved between successive pulses. In the case of the signals shown in FIG. 1, the voltage amplitude of the pulse A is substantially constant, and the time interval between the pulses A and B is also substantially constant. It is therefore considered that the degree of the influence caused by the pulse A on the threshold level of inversion of the liquid crystal is substantially the same for all the signals S1 to S6. In this case, therefore, the time interval between the pulse A and the pulse B is set to be extremely short, on condition that the voltage amplitude of the pulse B is corrected with a predetermined correction coefficient against any influence of the pulse A on the invention threshold level of the liquid crystal cell. In contrast, in the case of the signals shown in FIG. 7, intervals greater than the minimum relaxation timer are preserved between successive pulses A, B, C and D. Thus, in both cases, the intervals between the second and third pulses onward are determined to be not shorter than the minimum relaxation time in both of the signal timings shown in FIGS. 1 and 7, and this is one of the critical features of the present invention.

A liquid crystal cell having a construction as shown in FIG. 5 was fabricated by using a ferroelectric liquid crystal having characteristics shown below.

LIQUID CRYSTAL A

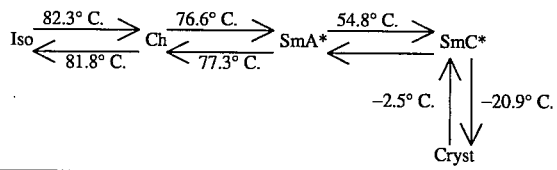

| | |
|---|---|
| Ps = 5.8 nC/cm$^2$ | 30° C. |
| Tilt angle = 14.3° | 30° C. |
| $\Delta\epsilon$~0 | 30° C. |

A film LQ-1802 (commercial name, produced by Hitachi Chemical Co., Ltd.) was used as the alignment films shown in FIG. 5. The alignment treatment was conducted by rubbing both the upper and lower substrates in the same direction, whereby about 10° clockwise twisting of the liquid crystal starting from the lower substrate towards the upper substrate, as viewed from the top side of the cell, was obtained. The cell thickness was varied within the range between 1.0 μm and 1.4 μm, as viewed in section as shown in FIG. 5.

This liquid crystal showed a threshold voltage of 12.2 V/μm at 30° C. for a pulse of 40 μs, and the pixels had threshold value which varied between 12.1 V and 17.1 V for a pulse of 40 μs at 30° C. The liquid crystal cell thus obtained was driven at each of the signal timings shown in FIGS. 1 and 7 by employing, as the pulses B and D, gradation data signals proportional to the threshold levels. A display with a high degree of gradation could be obtained in each case.

In the described embodiment, the scanning signal voltage was set on condition that the data signal voltage varies within the range between −5 V and +5 V. This, however, is only illustrative and the variation range of the data signal voltage may be set to, for example, 0 to +5 V.

As will be understood from the foregoing description, according to the present invention, it is possible to obtain a liquid crystal display apparatus which can realize a display with an analog gradation control.

Furthermore, a very stable control of gradation is possible regardless of any change in the cell thickness and the temperature.

In addition, it is possible to prevent, when data is to be written by a writing pulse, any shifting of the inversion threshold level of the liquid crystal caused by any immediately preceding pulse, by virtue of the fact that a time interval which is not shorter than the relaxation time is preserved between successive pulses. It is also to be noted that, since an interval not shorter than the minimum relaxation time is preserved between the successive pulses, it is possible to apply at least one of the plurality of pulses to a plurality of scanning lines at a common timing, which enables an appreciable reduction in the time required for scanning one frame of display.

What is claimed is:

1. A liquid crystal display apparatus for forming a gradation image on a liquid crystal display including a plurality of scanning electrodes disposed on a first substrate, a plurality of signal electrodes disposed on a second substrate opposed to and spaced from the first substrate in a manner perpendicular to the scanning electrodes and a bistable ferroelectric liquid crystal material disposed in a gap between the first and second substrates so that a matrix of pixels is defined by the opposing scanning and signal electrodes, wherein said pixels have respective threshold voltages of respective magnitudes for causing an inversion of a display state thereof, said liquid crystal display apparatus comprising:

(a) means for transmitting a reset pulse for resetting all the pixels on a selected scanning electrode into a first stable state; and (b) means for transmitting, in succession to the reset pulse, a selection signal to each of the pixels on the selected scanning electrode to cause an area ratio of light transmission Iop (%) of each of the pixels to take a respective desired value such that $0 \leqq Iop \leqq 100$, said selection signal comprising four or more pulses in combination with the reset pulse applied at sufficient predetermined intervals to a subject pixel such that a threshold voltage for causing inversion of the subject pixel during application of each pulse is undistorted by influence of each preceding pulse, wherein the timing of application of at least one pulse of the selection signal is applied to each of a plurality of scanning electrodes simultaneously.

2. A liquid crystal display apparatus according to claim 1, wherein said predetermined interval is also preserved between the reset pulse and the first writing pulse.

3. A liquid crystal display apparatus according to claim 1, wherein each of the pixels has a distribution of a threshold voltage level for causing an inversion of the liquid crystal between the two stable states.

4. A liquid crystal display apparatus for forming a gradation image on a liquid crystal display including a plurality of scanning electrodes disposed on a first substrate, a plurality of signal electrodes disposed on a second substrate opposed to and spaced from the first substrate in a manner perpendicular to the scanning electrodes and a bistable ferroelectric liquid crystal material disposed in a gap between the first and second substrates so that a matrix of pixels is defined by the opposing scanning and signal electrodes, wherein said pixels have respective threshold voltages of respective magnitudes for causing an inversion of a display state thereof, said liquid crystal display apparatus comprising:

(*a*) means for transmitting a reset pulse for resetting all the pixels on a selected scanning electrode into a first stable state;

(*b*) means for transmitting, in succession to the reset pulse, a selection signal to each of the pixels on the selected scanning electrode to cause an area ratio of light transmission Iop (%) of each of the pixels to take a respective desired value such that $0 \leqq Iop \leqq 100$, said selection signal comprising four or more pulses in combination with the reset pulse applied at sufficient predetermined intervals to a subject pixel such that a threshold voltage for causing inversion of the subject pixel during application of each pulse is undistorted by influence of each preceding pulse; and (*c*) means for controlling transmission of the selection signal to the pixels on the selected scanning electrode such that pixels having relatively higher respective threshold voltages are controlled to have their respective desired value before pixels having a relatively lower threshold voltages are controlled to have their respective desired value, wherein the timing of application of at least one pulse of the selection signal is applied to each of a plurality of scanning electrodes simultaneously.

5. A liquid crystal display apparatus for forming a Gradation image on a liquid crystal display including a plurality of pixels, each pixel having a pair of electrodes and a chiral smectic liquid crystal material disposed between the pair of electrodes, wherein said pixels have respective threshold values of respective magnitudes for causing an inversion of a display state thereof, said liquid crystal display apparatus comprising a driver that applies a reset pulse that resets all the pixels on a selected scanning line into a first state, the driver also applying, in succession to the reset pulse, a selection signal to each of the pixels on the selected scanning line to cause an area ratio of light transmission Iop (%) of each of the pixels to take a respective desired value such that $0 \leqq Iop \leqq 100$, said selection signal comprising four or more pulses in combination with the reset pulse applied at sufficient predetermined intervals to a subject pixel such that a threshold value for causing inversion of the subject pixel during application of each pulse is undistorted by influence of each preceding pulse, wherein the timing of application of at least one pulse of the selection signal is applied to each of the pixels on a plurality of scanning lines simultaneously.

6. A method for forming a gradation image on a liquid crystal display including a plurality of pixels, each pixel having a pair of electrodes and a chiral smectic liquid crystal material disposed between the pair of electrodes, said method comprising:

a first applying step of applying a reset pulse for resetting all the pixels on a selected scanning line into a first state; and a second applying step of applying, in succession to the reset pulse, a selection signal to each of the pixels on the selected scanning line to cause an area ratio of light transmission Iop (%) of each of the pixels to take a respective desired value such that $0 \leqq Iop \leqq 100$, the selection signal comprising at least three pulses applied at sufficient predetermined intervals to a subject pixel such that a threshold value for causing inversion of the subject pixel during application of each pulse is substantially undistorted by influence of each preceding pulse, wherein the timing of application of at least one of pulses of the selection signal is applied to each of the pixels on a plurality of scanning lines simultaneously.

* * * * *

UNITED STATES PATENT AND TRADEMARK OFFICE

CERTIFICATE OF CORRECTION

PATENT NO. : 5,608,420

DATED : March 4, 1997

INVENTOR(S) : SHINJIRO OKADA

It is certified that error appears in the above-identified patent and that said Letters Patent is hereby corrected as shown below:

Item

[57] ABSTRACT

Line 3, "including" should read --includes--.

COLUMN 1

Line 38, "4802,740;" should read --4,802,740;--.
Line 53, "high" should read --a high--.

COLUMN 2

Line 33, "D." should read --D;--.
Line 65, "(Iop(%)" should read --(Iop(%))--.

COLUMN 4

Line 16, "(2)" should read --¶ (2)--.
Line 26, "wall i," should read --walls i,--.

COLUMN 6

Line 5, "voltage $V_s$ $V_i$" should read --voltage $V_s$-$V_i$--.
Line 34, "commonside" should read --common-side--.

UNITED STATES PATENT AND TRADEMARK OFFICE

CERTIFICATE OF CORRECTION

PATENT NO. : 5,608,420

DATED : March 4, 1997

INVENTOR(S) : SHINJIRO OKADA

It is certified that error appears in the above-identified patent and that said Letters Patent is hereby corrected as shown below:

COLUMN 7

Line 23, "times" should read --time--.
Line 64, "timer" should read --time--.

COLUMN 10

Line 11, "Gra-" should read --gra--.

Signed and Sealed this

Seventh Day of October, 1997

*Attest:*

*Attesting Officer*

BRUCE LEHMAN

*Commissioner of Patents and Trademarks*